US008355921B2

(12) United States Patent
Tammi et al.

(10) Patent No.: US 8,355,921 B2
(45) Date of Patent: Jan. 15, 2013

(54) METHOD, APPARATUS AND COMPUTER PROGRAM PRODUCT FOR PROVIDING IMPROVED AUDIO PROCESSING

(75) Inventors: Mikko Tapio Tammi, Tampere (FI); Miikka Tapani Vilermo, Tampere (FI)

(73) Assignee: Nokia Corporation, Espoo (FI)

( * ) Notice: Subject to any disclaimer, the term of this patent is extended or adjusted under 35 U.S.C. 154(b) by 849 days.

(21) Appl. No.: 12/139,101

(22) Filed: Jun. 13, 2008

(65) Prior Publication Data

US 2009/0313028 A1 Dec. 17, 2009

(51) Int. Cl.
*G10L 21/04* (2006.01)

(52) U.S. Cl. ..... 704/503; 704/209; 704/200.1; 704/205; 704/225; 381/24; 381/28; 381/57; 381/71.7; 375/347; 708/321

(58) Field of Classification Search ..... 381/100, 381/24, 28, 57, 71.1; 704/500–504, 209, 704/200.1, 205, 207, 225, 249, 208; 725/114, 725/129, 135; 708/321, 315; 375/347, 346
See application file for complete search history.

(56) References Cited

U.S. PATENT DOCUMENTS

| | | | | |
|---|---|---|---|---|
| 5,434,948 | A | 7/1995 | Holt et al. | |
| 5,615,302 | A * | 3/1997 | McEachern | 704/209 |
| 6,801,887 | B1 * | 10/2004 | Heikkinen et al. | 704/206 |
| 7,376,557 | B2 * | 5/2008 | Specht et al. | 704/225 |
| 7,583,805 | B2 * | 9/2009 | Baumgarte et al. | 381/61 |
| 7,610,205 | B2 * | 10/2009 | Crockett | 704/503 |
| 7,804,972 | B2 * | 9/2010 | Melanson | 381/303 |
| 7,885,819 | B2 * | 2/2011 | Koishida et al. | 704/500 |
| 8,023,600 | B2 * | 9/2011 | Lindoff et al. | 375/347 |
| 2003/0026441 | A1 | 2/2003 | Faller | |
| 2003/0219130 | A1 * | 11/2003 | Baumgarte et al. | 381/17 |
| 2005/0071153 | A1 * | 3/2005 | Tammi et al. | 704/219 |
| 2005/0180579 | A1 * | 8/2005 | Baumgarte et al. | 381/63 |
| 2006/0178870 | A1 * | 8/2006 | Breebaart et al. | 704/205 |
| 2006/0190247 | A1 | 8/2006 | Lindblom | |
| 2007/0097942 | A1 * | 5/2007 | Gorokhov et al. | 370/342 |
| 2007/0233466 | A1 * | 10/2007 | Tammi | 704/200.1 |
| 2008/0031463 | A1 | 2/2008 | Davis | |
| 2008/0319739 | A1 * | 12/2008 | Mehrotra et al. | 704/200.1 |

(Continued)

FOREIGN PATENT DOCUMENTS

CN 1669358 (A) 9/2005

(Continued)

OTHER PUBLICATIONS

Faller, C. et al.., *Binaural Cue Coding—Part II: Schemes and Applications, IEEE Transactions on Speech and Audio Processing*, vol. II, No. 6, Nov. 2003, pp. 520-531.

(Continued)

*Primary Examiner* — Vijay B Chawan
(74) *Attorney, Agent, or Firm* — Alston & Bird LLP

(57) ABSTRACT

An apparatus for performing improved audio processing may include a processor. The processor may be configured to divide respective signals of each channel of a multi-channel audio input signal into one or more spectral bands corresponding to respective analysis frames, select a leading channel from among channels of the multi-channel audio input signal for at least one spectral band, determine a time shift value for at least one spectral band of at least one channel, and time align the channels based at least in part on the time shift value.

30 Claims, 6 Drawing Sheets

U.S. PATENT DOCUMENTS

2009/0112606 A1* 4/2009 Mehrotra et al. ..... 704/500

FOREIGN PATENT DOCUMENTS

| | | | |
|---|---|---|---|
| CN | 101120615 (A) | | 2/2008 |
| WO | WO 2004/072956 | A1 | 8/2004 |
| WO | WO 2006/089570 | A1 | 8/2006 |
| WO | WO 2007/080225 | A1 | 7/2007 |

OTHER PUBLICATIONS

International Search Report for PCT/FI2009/050306, mailed Aug. 27, 2009.

Breebaart, J. et al., *Parametric Coding of Stereo Audio*, EURASIP Journal on Applied Signal Processing, Sep. 2005, pp. 1305-1322.

Samsudin et al., *A Stereo to Mono Dowmixing Scheme for MPEG-4 Parametric Stereo Encoder*, IEEE Conference on Acoustics, Speech and Signal Processing (ICASSP) 2006, vol. 5, May 2006, pp. V-529-V-532.

Lindblom, J. et al., *Flexible Sum-Difference Stereo Coding Based on Time-Aligned Signal Components*, IEEE Workshop on Applications of Signal Processing to Audio and Acoustics 2005, Oct. 2005, pp. 255-258.

First Office Action for Chinese Patent Application No. 200980127463.1, dated Jan. 29, 2012.

Supplemental European Search Report for EP 09761843, dated Jul. 31, 2012.

Kurniawati et. al., "A Subband Domain Downmixing Scheme for Parametric Stereo Encoder," AFS Convention 120, dated May 20-23, 2006.

* cited by examiner

METHOD, APPARATUS AND COMPUTER PROGRAM PRODUCT FOR PROVIDING IMPROVED AUDIO PROCESSING

TECHNOLOGICAL FIELD

Embodiments of the present invention relate generally to audio processing technology and, more particularly, relate to a method, apparatus, and computer program product for providing improved audio coding.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to provision of devices capable of delivering a quality audio representation of audible content or audible communications. Multi-channel audio coding, which involves the coding of two or more audio channels together, is one example of a mechanism aimed at improving device capabilities with respect to providing quality audio signals. In particular, since in many usage scenarios the channels of the input signal may have relatively similar content, joint coding of channels may enable relatively efficient coding and with a lower bit-rate than that which may otherwise be utilized for coding each channel separately.

A recent multi-channel coding method is known as parametric stereo—or parametric multi-channel—coding. Parametric multi-channel coding generally computes one or more mono signals—often referred to as down-mix signals—as a linear combination of set of input signals. Each of the mono signals may be coded using a conventional mono audio coder. In addition to creating and coding the mono signals, the parametric multi-channel audio coder may extract a parametric representation of the channels of the input signal. Parameters may comprise information on level, phase, time, coherence differences, or the like, between input channels. At the decoder side, the parametric information may be utilized to create a multi-channel output signal from the received decoded mono signals.

Parametric multi-channel coding methods, which represent one example of a multi-channel coding method, such as Binaural Cue Coding (BCC) enable high-quality stereo or multi-channel reproduction with a reasonable bit-rate. The compression of a spatial image is based on generating and transmitting one or several down-mixed signals derived from a set of input signals, together with a set of spatial cues. Consequently, the decoder may use the received down-mixed signal(s) and spatial cues for synthesizing a set of channels, which is not necessarily the same number of channels as in the input signal, with spatial properties as described by the received spatial cues.

The spatial cues typically comprise Inter-Channel Level Difference (ICLD), Inter-Channel Time Difference (ICTD) and Inter-Channel Coherence/Correlation (ICC). ICLD and ICTD typically describe the signal(s) from the actual audio source(s), whereas the ICC is typically directed to enhancing the spatial sensation by introducing the diffuse component of the audio image, such as reverberations, ambience, etc. Spatial cues are typically provided for each frequency band separately. Furthermore, the spatial cues can be computed or provided between an arbitrary channel pair, e.g. between a chosen reference channel and each "sub-channel".

Binaural signals are a special case of stereo signals that represent three dimensional audio image. Such signals model the time difference between the channels and the "head shadow effect", which may be accomplished, e.g., via reduction of volume in certain frequency bands. In some cases, binaural audio signals can be created either by using a dummy head or other similar arrangement for recording the audio signal, or they can be created from pre-recorded audio signals by using special filtering implementing a head-related transfer function (HRTF) aiming to model the "head shadow effect" for providing suitably modified signals to both ears.

Since the correct representation of the time and amplitude differences between the channels of the encoded audio signal is an important factor on the resulting perceived audio quality in multi-channel audio coding in general and in binaural coding in particular, it may be desirable to introduce a mechanism paying special attention to these aspects.

BRIEF SUMMARY

A method, apparatus and computer program product are therefore provided for providing an improved audio coding/decoding mechanism. According to example embodiments of the present invention, multiple channels may be efficiently combined into one channel via a time alignment of the channel signals. Thus, for example, the time difference between channels may be removed at the encoder side and restored at the decoder side. Moreover, embodiments of the present invention may enable time alignment that can be tracked over different times and different frequency locations due to the fact that input signals may have different time alignments over different times and frequency locations and/or several source signals occupying the same time-frequency location.

In one example embodiment, a method of providing improved audio coding is provided. The method may include dividing respective signals of each channel of a multi-channel audio input signal into one or more spectral bands corresponding to respective analysis frames, selecting a leading channel from among channels of the multi-channel audio input signal for at least one spectral band, determining a time shift value for at least one spectral band of at least one channel, and time aligning the channels based at least in part on the time shift value.

In another example embodiment, a computer program product for providing improved audio coding is provided. The computer program product includes at least one computer-readable storage medium having computer-executable program code portions stored therein. The computer-executable program code portions may include first, second, third and fourth program code portions. The first program code portion is for dividing respective signals of each channel of a multi-channel audio input signal into one or more spectral bands corresponding to respective analysis frames. The second program code portion is for selecting a leading channel from among channels of the multi-channel audio input signal for at least one spectral band. The third program code portion is for determining a time shift value for at least one spectral band of at least one channel. The fourth program code portion is for time aligning the channels based at least in part on the time shift value.

In another example embodiment, an apparatus for providing improved audio coding is provided. The apparatus may include a processor. The processor may be configured to divide respective signals of each channel of a multi-channel audio input signal into one or more spectral bands corresponding to respective analysis frames, select a leading channel from among channels of the multi-channel audio input signal for at least one spectral band, determine a time shift value for at least one spectral band of at least one channel, and time align the channels based at least in part on the time shift value.

In another example embodiment, a method of providing improved audio coding is provided. The method may include dividing a time aligned decoded audio input signal into spectral bands corresponding to respective analysis frames for multiple channels, receiving time shift values relative to a leading channel for a channel other than the leading channel for each of the spectral bands, and restoring time differences between the multiple channels using the time shift values to provide a synthesized multi-channel output signal.

In another example embodiment, a computer program product for providing improved audio coding is provided. The computer program product includes at least one computer-readable storage medium having computer-executable program code portions stored therein. The computer-executable program code portions may include first, second and third program code portions. The first program code portion is for dividing a time aligned decoded audio input signal into spectral bands corresponding to respective analysis frames for multiple channels. The second program code portion is for receiving time shift values relative to a leading channel for a channel other than the leading channel for each of the spectral bands. The third program code portion is for restoring time differences between the multiple channels using the time shift values to provide a synthesized multi-channel output signal.

In another example embodiment, an apparatus for providing improved audio coding is provided. The apparatus may include a processor. The processor may be configured to divide a time aligned decoded audio input signal into spectral bands corresponding to respective analysis frames for multiple channels, receive time shift values relative to a leading channel for a channel other than the leading channel for each of the spectral bands, and restore time differences between the multiple channels using the time shift values to provide a synthesized multi-channel output signal.

Embodiments of the invention may provide a method, apparatus and computer program product for employment in audio coding/decoding applications. As a result, for example, mobile terminals and other electronic devices may benefit from improved quality with respect to audio encoding and decoding operations.

BRIEF DESCRIPTION OF THE DRAWINGS

Figure 1:
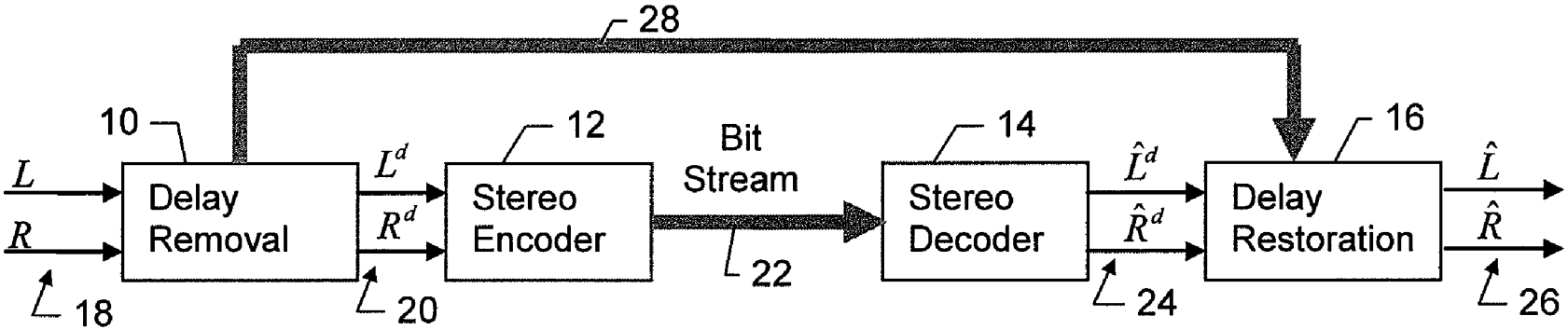
Figure 2:
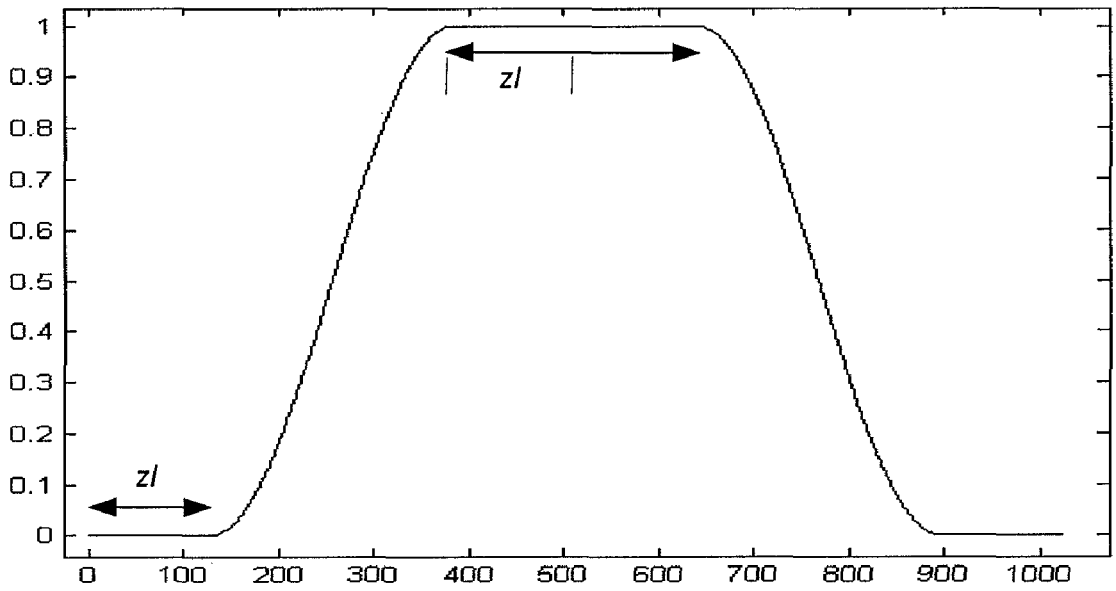
Figure 3:
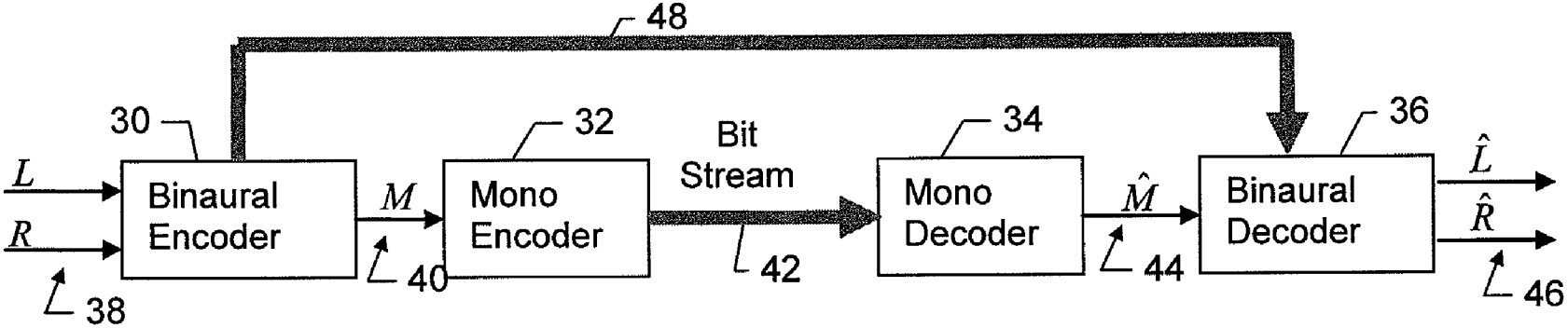
Figure 4:
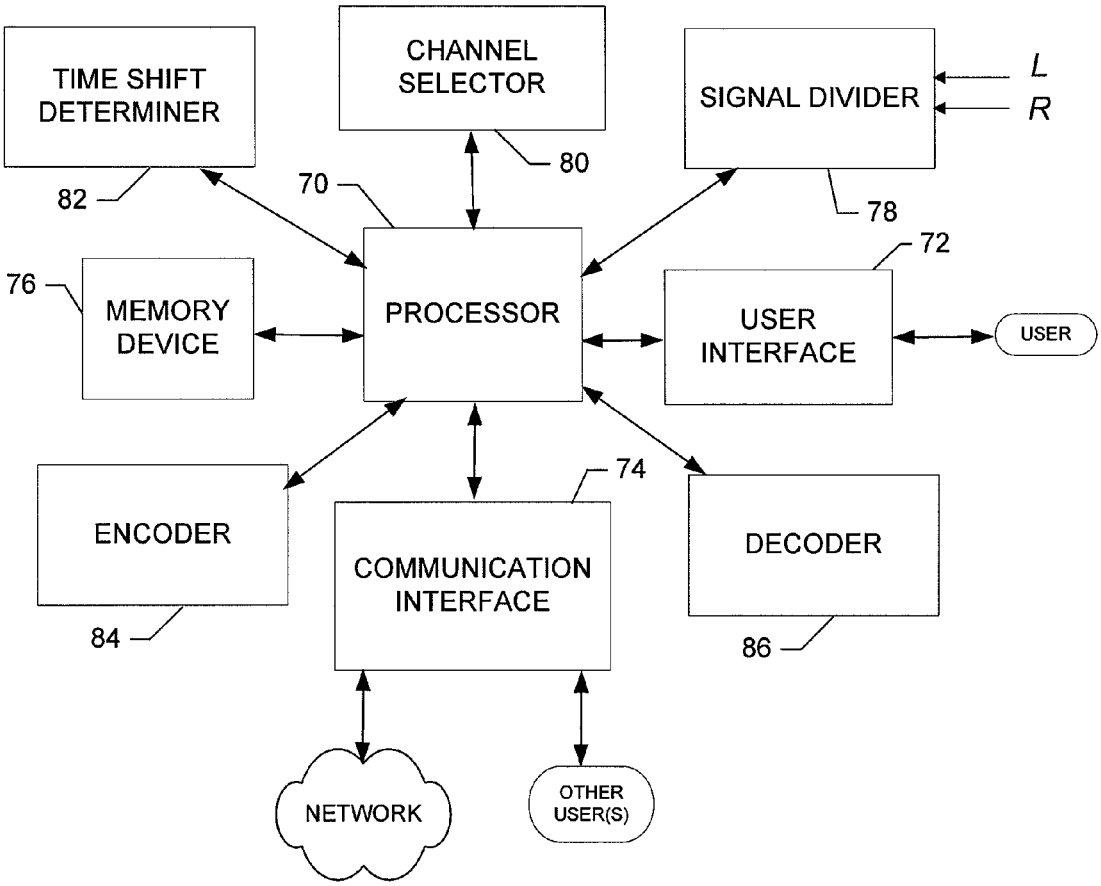
Figure 5:
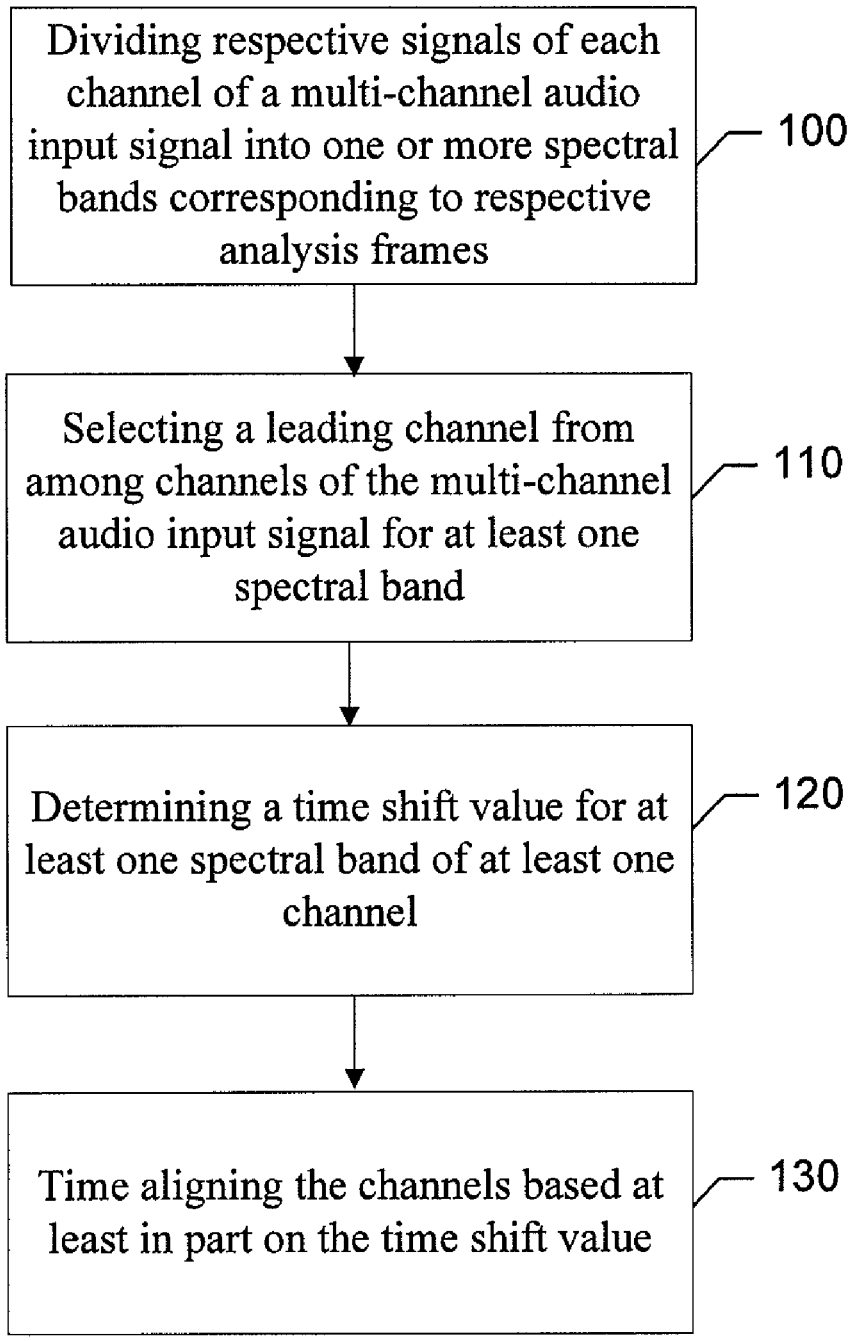
Figure 6:
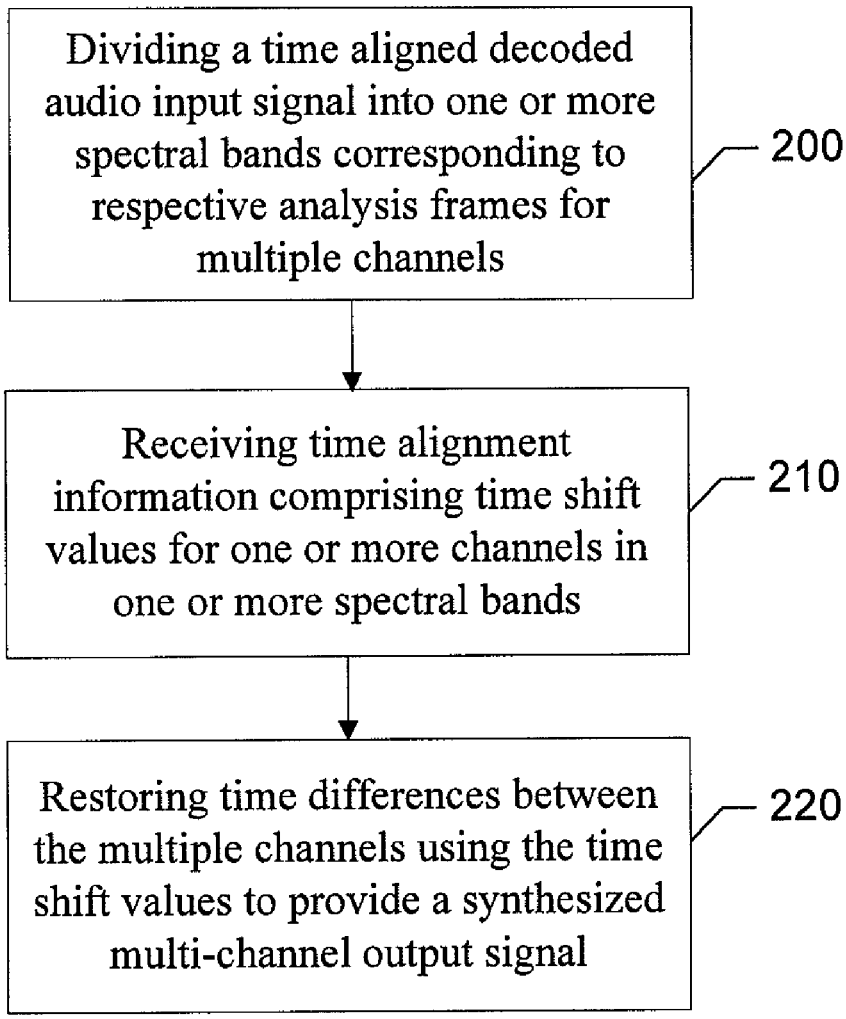

Having thus described embodiments of the invention in general terms, reference will now be made to the accompanying drawings, which are not necessarily drawn to scale, and wherein:

FIG. 1 illustrates a block diagram of a system for providing audio processing according to an example embodiment of the present invention;

FIG. 2 illustrates an example analysis window according to an example embodiment of the present invention;

FIG. 3 illustrates a block diagram of an alternative system for providing audio processing according to an example embodiment of the present invention;

FIG. 4 illustrates a block diagram of an apparatus for providing audio processing according to an example embodiment of the present invention;

FIG. 5 is a flowchart according to an example method for providing audio encoding according to an example embodiment of the present invention; and FIG. 6 is a flowchart according to an example method for providing audio decoding according to an example embodiment of the present invention.

DETAILED DESCRIPTION

Embodiments of the present invention will now be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

The channels of a multi-channel audio signal representing the same audio source typically introduce similarities to each other. In many cases the channel signals differ mainly in amplitude and phase. This may be especially pronounced for binaural signals, where the phase difference is one of the important aspects contributing to the perceived spatial audio image. The phase difference may, in practice, be represented as the time difference between the signals in different channels. The time difference may be different across frequency bands, and the time difference may change from one time instant to another.

In a typical multi-channel coding method in which the mono—i.e. down-mix—signals are created as a linear combination of the channels of the input signal, the mono signals may become a combination of signals, which may have essentially similar content but may have a time difference in relation to each other. From this kind of combined signal it may not be possible to generate the channels of an output signal having perceptually equal properties with respect to the input signal. Thus, it may be beneficial to pay special attention to the handling of phase—or time difference—information to enable high-quality reproduction, especially in case of binaural signals.

FIG. 1 illustrates a block diagram of a system for providing audio processing according to an example embodiment of the present invention. In this regard, FIG. 1 and its corresponding description represent an extension of existing stereo coding methods for coding binaural signals and other stereo or multi-channel signals where time differences may exist between input channels. By time difference we mean the temporal difference—expressed for example as milliseconds or as number of signal samples—between the occurrences of the corresponding audio event on channels of the multi-channel signal. As shown in FIG. 1, an example embodiment of the present invention may estimate the time difference and apply appropriate time shift to some of the channels to remove the time difference between the input channels prior to initiating stereo coding. At the decoding side, the time difference between the input channels may be returned by compensating the time shift possibly applied in the encoder side so that the output of the stereo decoder introduces the time difference originally included in the input signal in the encoder side. Although the example embodiment presented herein is illustrated using two input and output channels and stereo encoder and stereo decoder, the description is equally valid for any multi-channel signal consisting of two or more channels and employing multi-channel encoder and multi-channel decoder.

Referring now to FIG. 1, a system for providing audio processing comprises a delay removal device 10, a stereo encoder 12, a stereo decoder 14 and a delay restoration device 16. Each of the delay removal device 10, the stereo encoder 12, the stereo decoder 14 and the delay restoration device 16 may be any means or device embodied in hardware, software or a combination of hardware and software for performing the corresponding functions of the delay removal device 10, the stereo encoder 12, the stereo decoder 14 and the delay restoration device 16, respectively.

In an example embodiment, the delay removal device 10 is configured to estimate a time difference between input channels and to time-align the input signal by applying time shift to some of the input channels, if needed. In this regard, for example, if an input signal 18 comprises two channels such as a left channel L and a right channel R, the delay removal device 10 is configured to remove any time difference between corresponding signal portions of the left channel L and the right channel R. The corresponding signal portions may be offset in time, for example, due to a distance between microphones capturing a particular sound event (e.g., a beginning of sound is heard at a location of the closer microphone to the sound source a few milliseconds before the beginning of the same sound is heard at the location of the more distant microphone). Many alternative methods may be employed for removing and restoring the time difference, some of which are described herein by way of example and not of limitation. In an example embodiment, processing of the input signal 18 is carried out using overlapping blocks or frames. However, in alternative examples, non-overlapping blocks may be utilized, as described in greater detail below.

In an example embodiment, the delay removal device 10 may comprise or be embodied as a filter bank. In some cases, the filter bank may be non-uniform such that certain frequency bands are narrower than others. For example, at low frequencies the bands of the filter bank may be narrow and at high frequencies the bands of the filter bank may be wide. An example of such a division to frequency bands is the division to so called critical bands, which model the properties of the human auditory system introducing decreasing subjective frequency resolution with increasing frequency. The filter bank divides each channel of the input signal 18 (e.g., the left channel L and the right channel R) into a particular number of frequency bands B. The bands of the left channel L are described as $L_1, L_2, L_3, \ldots, L_B$. Similarly, the bands of the right channel R are described as $R_1, R_2, R_3, \ldots, R_B$. In an example embodiment having the number of frequency bands B equal to 1, a filter bank may or may not be employed.

In an example embodiment, the channels are divided into blocks or frames either before or after the filter bank. The signal may or may not be windowed in the division process. Furthermore, in case windowing is used, the windows may or may not overlap in time. Note also that as special case a window of all ones with a length matching the frame length introduces a case similar to one without windowing and without overlap. As indicated above, in one example embodiment, the blocks or frames overlap in time. Windowed blocks of the left channel L, window i, and band b may be defined as $L_b(iN+k)$, k=0, . . . , I. In this regard, variable N represents the effective length of the block. In other words here the variable N indicates how many samples the starting point of a current block differs from the starting point of a previous block. The length of the window is indicated by the variable I.

In an example embodiment, the analysis windows are selected to overlap. As such, for example, a window of the following form may be selected:

$$\text{win_tmp} = \left[\sin\left(2\pi\frac{\frac{1}{2}+k}{wtl} - \frac{\pi}{2}\right) + 1\right]/2,\ k = 0, \ldots, wtl-1$$

$$win(k) = \begin{cases} 0, & k = 0, \ldots, zl \\ \text{win_tmp}(k-(zl+1)), & k = zl+1, \ldots, zl+wtl \\ 1, & k = zl+wtl, \ldots, wl/2 \\ 1, & wl/2+1, \ldots, wl/2+ol \\ \text{win_tmp}(wl-zl-1-(k-(wl/2+ol+1))), & k = wl/2+ol+1, \ldots, wl-zl-1 \\ 0, & k = wl-zl, \ldots, wl-1, \end{cases}$$

where wtl is the length of the sinusoidal part of the window, zl is the length of leading zeros in the window and ol is half of the length of ones in the middle of the window. In an example window shown above, the following equalities hold:

$$\begin{cases} zl + wtl + ol = \dfrac{\text{length}(win)}{2} \\ zl = ol. \end{cases}$$

The overlapping part of the window may be anything that sums up to 1 with the overlapping part of the windows of the adjacent frames. An example of a usable window shape is provided in FIG. 2.

According to an example embodiment, the delay removal device 10 is further configured to select one of the channels of the input signal 18 (e.g., the left channel L or the right channel R) as a leading or lead channel for every band separately. Thus, in an example embodiment one of the respective bands of the left channel L including $L_1, L_2, L_3, \ldots, L_B$ and one of the respective frequency bands of the right channel R including $R_1, R_2, R_3, \ldots, R_B$ is selected for each band as the leading channel. In other words, for example, $L_1$ is compared to $R_1$ and one of the two channels is selected as the leading channel for the particular respective band. Selection of a leading channel may be based on several different criteria and may vary on a frame by frame basis. For example, some criteria may include selection of the psychoacoustically most relevant channel, e.g., the loudest channel, channel introducing the highest energy, channel in which an event is detected first, or the like. However, in some example embodiments, a fixed channel may be selected as the leading channel. In other example embodiment the leading channel may be selected only for parts of the frequency bands. For example, the leading channel may be selected only for the selected number of the lowest frequency bands. In an alternative example embodiment, any arbitrary set of frequency bands may be selected for leading channel analysis and time alignment.

According to an example embodiment, a time difference $d_b(i)$ between similar portions on channels of the input signal for frequency band b in block i is computed. The computation may be based on, for example, finding the time difference that maximizes the cross-correlation between the signals of the respective frequency bands on different channels. The computation can be performed either in time domain or in frequency domain. Alternative example embodiments may employ other similarity measures. Alternative methods include, for example, finding the time difference by comparing the phases of the most significant signal components between the channels in frequency domain, finding the maximum and/or minimum signal components in each of the channels and estimating the time difference between the corresponding components in each of the channels in time domain, evaluating the correlation of zero-crossing locations on each of the channels, etc.

Based on the time difference value and the leading channel selection, time shifts for each of the channels are determined on a frame by frame basis. Thus, for example, the time shift for frequency band b in frame i may be obtained as shown in the pseudo code below.

If $L_b$ is the leading channel in current block i and frequency band b:

$$L_b^d(iN+k)=L_b(iN+k)$$

$$R_b^d(iN+k)=R_b(iN+k+d_b(i))'$$

otherwise (e.g., if $R_b$ is the leading channel)

$$L_b^d(iN+k)=L_b(iN+k+d_b(i))$$

$$R_b^d(iN+k)=R_b(iN+k),$$

where k=0, . . . , I.

According to this example embodiment, the leading channel is not modified whereas a time shift equal to $d_b(i)$ is applied to the other channels. In other words, in this example embodiment, for a given frequency band in a given frame, the leading channel is not shifted in time and a time shift is defined for the non-leading channels relative to the leading channel.

As such, embodiments of the present invention may utilize the delay removal device 10 to divide the multi-channel input signal 18 into one or more frequency bands on respective different channels and select one of the channels as the leading channel on each of the respective bands. A time difference of a portion of a non-leading channel that is most similar to a corresponding portion of the leading channel may then be defined. Based on the defined time difference a time shift operation is applied to time-align the input channels, and the information on the applied time shift may be communicated to the delay restoration device 16, e.g., as time alignment information 28. The time alignment information 28 may comprise the time shifts applied to the frequency bands of the non-leading channels of current frame by the delay removal device 10. In some embodiments the time alignment information 28 may further comprise the indication on the leading channel for frequency bands of the current frame. In some embodiments, also the leading channel may be time shifted. In such a case the time alignment information 28 may also comprise time shift applied to the leading channel. In some embodiments, an allowed range of time shifts may be limited. One example of the aspects possibly limiting the range of allowed time shifts may be the length of the overlapping part of the analysis window.

In an example embodiment, an output signal 20 provided by the delay removal device 10 comprises signals $L^d$ and $R^d$, which may be obtained by combining the time aligned frequency band signals for a current block and then joining successive blocks together based on an overlap-add. Signals $L^d$ and $R^d$ are fed to the stereo encoder 12, which performs stereo encoding. In an example embodiment, the stereo encoder 12 may be any stereo encoder known in the art.

After stereo encoding signals $L^d$ and $R^d$, a bit stream 22 is generated. The bit stream 22 may be stored for future communication to a device for decoding or may immediately be communicated to a device for decoding or for storage for future decoding. Thus, for example, the bit stream 22 may be stored as an audio file in a fixed or removable memory device, stored on a compact disc or other storage medium, buffered, or otherwise saved or stored for future use. The bit stream 22 may then, at some future time, be read by a device including a stereo decoder and converted to a decoded version of the input signal 18 as described below. Alternatively, the bit stream 22 may be communicated to the stereo decoder 14 via a network or other communication medium. In this regard, for example, the bit stream 22 may be transmitted wirelessly or via a wired communication interface from a device including the stereo encoder 12 (or from a storage device) to another device including the stereo decoder 14 for decoding. As such, for example, the bit stream 22 could be communicated via any suitable communication medium to the stereo decoder 14.

The bit stream 22 may be received by the stereo decoder 14 for decoding. In an example embodiment, the stereo decoder 14 may be any stereo decoder known in the art (compatible with the bit stream provided by the stereo encoder 12). As such, the stereo decoder 14 decodes the bit stream 22 to provide an output signal 24 including synthesized signals $\hat{L}^d$ and $\hat{R}^d$. The synthesized signals $\hat{L}^d$ and $\hat{R}^d$ of the output signal 24 are then communicated to the delay restoration device 16. The delay restoration device 16 is configured to restore the time differences of the original input signal 18 by performing an inverse operation with respect to the time alignment that occurred at the delay removal device 10, i.e. to inverse the time shift applied by the delay removal device 10, to produce the restored output 26.

In an example embodiment, the delay restoration device 16 is configured to restore the time differences that were removed by the delay removal device 10. As such, for example, the delay restoration device 16 may utilize time alignment information 28 determined by the delay removal device 10 in order to restore the time differences. Of note, the time alignment information 28 need not be provided by a separate channel or communication mechanism. Rather, the line showing communication of the time alignment information 28 in FIG. 1 may be merely representative of the fact that the time alignment information 28 comprising information that is descriptive of the time shifting applied to the input signal 18 by the delay removal device 10 is provided ultimately to the delay restoration device 16. As such, for example, the time alignment information 28 may actually be communicated via the bit stream 22. Thus, the delay restoration device 16 may extract the time alignment information 28 from the output signal 24 provided by the stereo decoder 14 to the delay restoration device 16. However, the time alignment information 28 need not necessarily be discrete information, but may instead be portions of data encoded in the bit stream 22 that is descriptive of time alignment or delay information associated with various blocks or frames of data in the bit stream. When decoded by the stereo decoder 14, the time alignment information 28 may be defined in relation to a time difference of one channel relative to the leading channel.

In an example embodiment, the delay restoration device 16 is configured to divide the output signal (e.g., $\hat{L}^d$ and $\hat{R}^d$) into blocks or frames and frequency bands. In another example embodiment the delay restoration device 16 may receive the signal divided into frequency bands by the stereo decoder 14, and further division into frequency bands may not be needed. The delay restoration device 16 receives the information on the time shift $d_b(i)$ applied to frequency bands b of the channels of current frame i. In some embodiments, the delay restoration device 16 further receives an indication on the leading channel of frequency bands of the current frame. In some cases, delay restoration is then performed, for example, as described in the pseudo code below.

If $L_b$ is the leading channel in current block i and frequency band b:

$$\hat{L}_b^d(iN+k)=\hat{L}_b(iN+k)$$

$$\hat{R}_b^d(iN+k+d_b(i))=\hat{R}_b(iN+k)'$$

otherwise (i.e. If $R_b$ is the leading channel)

$$\hat{L}_b^d(iN+k+d_b(i))=\hat{L}_b(iN+k)$$

$$\hat{R}_b^d(iN+k)=\hat{R}_b(iN+k),$$

where k=0, . . . , I.

The frequency bands and overlapping window sections are then combined to provide the restored output 26 comprising signals $\hat{L}$ and $\hat{R}$.

In an example embodiment, the delay removal device 10 may be embodied as a binaural encoder, providing a (logical) pre-processing function for the audio encoder. As such, the binaural encoder in this example embodiment is configured to take a stereo input signal, compute the time difference between the input channels, determine time shifts required for time-alignment of the input channels, and time-align the channels of the input signal before passing the signal to the stereo encoder 12. The time shift information may be encoded into the output provided by the binaural encoder, which may be stereo encoded and provided as a bit stream to a stereo decoder (e.g., the stereo decoder 14). After stereo decoding, the resultant signal will have the time differences restored therein by the delay restoration device 16 embodied, for example, as a binaural decoder providing a (logical) post-processing function for the audio decoder. The binaural decoder may utilize the time shift information to restore time differences into the restored output. Thus, time difference between the input channels may be properly preserved through stereo encoding and decoding processes.

It should be understood that although the description above was provided in the context of a stereo signal, embodiments of the present invention could alternatively be practiced in other contexts as well. Thus, embodiments of the present invention may also be useful in connection with processing any input signal involving multiple channels where the channels differ from each other mainly by phase and amplitude, implying that the signals on different channels can be derived from each other by time shifting and signal level modification with acceptable accuracy. Such conditions arise for example when the sound from common source(s) is captured by a set of microphones or the channels of an arbitrary input signal are processed to differ mainly in phase and amplitude. Moreover, as also indicated above, embodiments of the present invention may be practiced in connection with implementations that operate in either time or frequency domains. Embodiments may also be provided over varying ranges of bit rates, possibly also with bit rate that is varying from frame to frame.

Additionally, although the description above has been provided in the context of stereo encoding and decoding, alternative embodiments could also be practiced in the context of mono encoding and decoding as shown, for example, in FIG. 3. In this regard, FIG. 3 illustrates a block diagram of an alternative system for providing audio processing according to an example embodiment of the present invention. As shown in FIG. 3, the system may comprise a binaural encoder 30 (which is an example of an encoder capable of multi-channel delay removal), a mono encoder 32, a mono decoder 34 and a binaural decoder 36 each of which may be any means or device embodied in hardware, software or a combination of hardware and software that is configured to perform the corresponding functions of the binaural encoder 30, the mono encoder 32, the mono decoder 34 and the binaural decoder 36 (which is an example of a decoder capable of multi-channel delay restoration), respectively, as described below.

In an example embodiment, the binaural encoder 30 may be configured to time-align the input channels as described above in connection with the description of the delay removal device 10. In this regard, the binaural encoder 30 may be similar to the delay removal device 10 except that the binaural encoder 30 of this example embodiment may provide a mono output M, shown by mono signal 40, after processing a stereo input signal 38. The mono output M may be generated, for example, by first estimating the time difference between the input channels and then time shifting some of the channels, as described above, and finally combining the time-aligned channels of the stereo input signal 38 (e.g., as a linear combination of the input channels) into a mono output M. Additional information, such as level information descriptive of the level differences between respective frequency bands and/or information descriptive of the correlation between the respective frequency bands may be provided along with the information on the time shift applied to frequency bands of the input signal as the time alignment information 48 and the mono output M in the mono signal 40. The mono signal 40 is then encoded by mono encoder 32, which may be any suitable mono encoder known in the art. The mono encoder 32 then produces a bit stream 42 which may be stored or communicated at some point to the mono decoder 34 for immediate decoding or for storage and later decoding. The mono decoder 34 may also be any suitable mono decoder known in the art (compatible with the bit stream provided by the mono encoder 32) and may be configured to decode encoded bit stream into a decoded mono signal 44. The decoded mono signal 44 may then be communicated to the binaural decoder 36.

In an example embodiment, the binaural decoder 36 is configured to utilize the time shift information received as part of the time alignment information 48 to reconstruct time differences in the stereo input signal 38 in order to produce a stereo output signal 46 corresponding to the stereo input signal 38. In this regard, the operation of the binaural decoder 36 may be similar to the operation of the delay restoration device 16 described above. However, the binaural decoder 36 of this example embodiment may be further configured to use the additional information received as part of the time alignment information 48, such as level information and or correlation information, to enhance the stereo signal from the decoded mono signal 44.

Accordingly, in general terms, an example embodiment of the present invention, similar to the embodiments described above, may be configured to divide an input signal into a plurality of frames and spectral bands. One channel among multiple input channels may then be selected as a leading channel and the time difference between the leading channel and the non-leading channel(s) may be defined, e.g. in terms of a time shift value for one or more frequency bands. As such, the channels may be time aligned with corresponding time shift values defined relative to each corresponding band so that the non-leading channels are essentially shifted in time. According to this example embodiment, the time aligned signals are then encoded and subsequently decoded using stereo or mono encoding/decoding techniques. At the decoder side, the determined time shift values may then be used for restoring the time difference in synthesized output channels.

In example embodiments, modifications and/or additions to the operations described above may also be applied. In this regard, for example, as described above, numerous criteria could be used for leading channel selection. According to an example embodiment, a perceptually motivated mechanism for time shifting the frequency bands of the input channels in relation to each other may be utilized. For example, the channel at which a particular event (e.g., a beginning of a sound after silence) is encountered first may be selected as the leading channel for a frequency band. Such a situation may occur, for example, if a particular event is detected first at the location of one microphone associated with a first channel, and at some later time the same event is detected at the location of another microphone associated with another channel, implying that the channel at which the particular event is encountered first may be selected as the leading channel for a frequency band. The corresponding frequency band(s) of the other channel(s) may then be aligned to the leading channel with corresponding time shift values defined based on the estimated time difference between the channels for encountering the particular event. The leading channel may change from one frame to the next based on from where the sounds encountered originate. Transitions associated with changes in leading channels may be performed smoothly in order to avoid large changes in time shift values from one frame to another. As such, each channel may be modified in a perceptually "safe" manner in order to decrease the risk of encountering artifacts.

In an example embodiment, the two input channels (e.g., the left channel L and the right channel R of the input signal 18) may be processed in frames. In each frame, the left channel L and the right channel R of the input signal 18 are divided into one or more frequency bands as described above. As indicated above, the frames may or may not overlap in time. As an example, let $L_b^i$ and $R_b^i$ be the frequency band b of frame i. Using for example cross-correlation between channels, a time difference value $d_b(i)$ between similar components on channels of the input signal may be determined to indicate how much $R_b^i$ should be shifted in order to make it as similar as possible with $L_b^i$. As described above, other example embodiments may use different similarity measures and different methods to estimate the time difference $d_b(i)$. The time difference can be expressed for example as milliseconds or as number of signal samples. In an example embodiment, when $d_b(i)$ is positive $R_b^i$ may be shifted forward in time and similarly when $d_b(i)$ is negative $R_b^i$ may be shifted backward in time.

In an example embodiment, instead of directly using the time difference $d_b(i)$ as the single time shift for a certain frequency band, as described above, a separate time shift parameter may be provided for each channel. Thus, for example, time shifts for frequency bands of the left channel L and the right channel R of the input signal 18 in frame i may be denoted as $d_b^L(i)$ and $d_b^R(i)$, respectively. Both of these parameters (e.g., $d_b^L(i)$ and $d_b^R(i)$) denote how much (e.g. how many samples) each respective frequency band in a corresponding channel is shifted in time. In an example embodiment, the equality $d_b^R(i)-d_b^L(i)=d_b(i)$ remains true to ensure correct time-alignment.

In an example situation, binaural signals corresponding to channels including data correlating to the occurrence of a particular event that is represented in each channel may be encountered. In such a situation, the channel in which the particular event occurs (or is represented) first in the data may be considered to be perceptually more important. Modifying sections that may be considered to be perceptually important may introduce a risk of introducing reductions in sound quality. Accordingly, it may be desirable in some cases to select the channel in which the particular event occurs first as the leading channel, and modify only the less important channels (e.g., the channels in which the particular event occurs later (e.g., the non-leading channels)). In this regard, it may be desirable to avoid shifting the channel (and/or the frequency band) in which the event occurs first.

As an example, the following logic may be used when selecting time shift values $d_b^L(i)$ and $d_b^R(i)$ based on time difference $d_b(i)$:

If $d_b(i)<0$ $$d_b^L(i)=0$$

$$d_b^R(i)=d_b(i)$$

If $d_b(i)\geqq 0$ $$d_b^L(i)=-d_b(i)$$

$$d_b^R(i)=0$$

Of note, in this example, the values of $d_b^L(i)$ and $d_b^R(i)$ in the example above are always equal to or smaller than zero, and thus only shifts backward in time are performed. In addition, very large shifts may not be performed for an individual channel from one frame to another. For example, in one example embodiment in which it is assumed that the biggest allowed shift is ±K samples, when $d_b(i-1)=-K$ and $d_b(i)=K$, it follows that $d_b^L(i-1)=0$, $d_b^L(i)=-K$, $d_b^R(i-1)=-K$ and $d_b^R(i)=0$. Thus, without other limitations, in this example the biggest possible time shift for a frequency band of an individual channel from one frame to another is K, not 2K samples. Thus, for example, a decreased risk of encountering perceptual artifacts may be experienced. Other paradigms for limiting size, sign or magnitude of the time shift on a given frequency band or size, sign or magnitude of the difference in time shifts between successive frames on a given frequency band could alternatively be employed in efforts to increase quality and reduce the occurrence of artifacts.

At the decoder side, inverse operations relative to the time shifts introduced by the binaural encoder or delay removal device (e.g., shifts $d_b^L(i)$ and $d_b^R(i)$) may be performed to enable the creation of a synthesized version of the input signals.

As described above, overlapping windows may be utilized in connection with determining frames or blocks for further division into spectral bands. However, non-overlapping windows may also be employed. Referring again to FIG. 1, an alternative example embodiment will now be described in which non-overlapping windows may be employed.

In this regard, for example, the delay removal device 10 may comprise or be embodied as a filter bank. The filter bank may divide each channel of the input signal 18 (e.g., the left channel L and the right channel R) into a particular number of frequency bands B. If the number of frequency bands B is 1, the filter bank may or may not be employed. In an example embodiment, no downsampling is performed for the resulting frequency band signals. In an alternative example embodiment, the frequency band signals may be downsampled prior to further processing. The filter bank may be non-uniform, as described above in that certain frequency bands may be narrower than others, for example, based on the properties of human hearing according to so called critical bands, as described above.

In this example embodiment, the filter bank divides channels of the input signal 18 (e.g., the left channel L and the right channel R) into a particular number of frequency bands B. The bands of the left channel L are described as $L_1$, $L_2$, $L_3$, . . . , $L_B$. Similarly, the bands of the right channel R are described as $R_1$, $R_2$, $R_3$, . . . , $R_B$. Unlike the scenario described above, in this example embodiment, the frames do not overlap.

In an example embodiment, in the delay removal device 10, each frequency band may be compared with a corresponding frequency band of the other channel in time domain. As such, for example, the cross-correlation between $L_b(i)$ and $R_b(i)$ may be computed to find a desired or optimal time difference between the channels. Consquently, the frequency bands $L_b(i)$ and $R_b(i)$ are most similar when a time shift corresponding to the estimated time difference is applied. In other example embodiments different similarity measures and search methods may be used to find the time difference measure, as described above. The time difference indicating the optimal time shift may be searched in range of ±K samples, where K is the biggest allowed time shift. For example, with a 32 kHz input signal sampling rate, a suitable value for K may be about 30 samples. Based on the optimal time difference and using, for example, the operations described above, a time shift may be obtained for both channels. The respective time shift values may be denoted as $d_b^L(i)$ and $d_b^R(i)$. Other methods may alternatively be used such as, for example, always modifying only the other channel or the like. In some example embodiments it may be considered reasonable to estimate and modify the time difference between channels on a subset of frequency bands, for example only for frequencies below 2 kHz. Alternatively, the time alignment processing may be performed on any arbitrary set of frequency bands, possibly changing from frame to frame.

Modification according to an example embodiment will now be described in the context of use in association with one frequency band of the left channel L as an example. The modification may be performed separately for each frequency band and channel. According to the example, let $d_b^L(i)$ and $d_b^L(i-1)$ be the time differences for frequency band b of the left channel L in a current frame and in previous frame, respectively. The change of time difference may be expressed as $\Delta d_b^L(i)=d_b^L(i)-d_b^L(i-1)$. The change of time difference may define how much the frequency band b is desirable to be modified. If $\Delta d_b^L(i)$ is zero there is no need for modification. In other words, if $\Delta d_b^L(i)$ is zero, the frequency band b of the current frame may be directly added to the end of the corresponding frequency band of the previous frame. When $\Delta d_b^L(i)$ is smaller than zero (e.g., a negative value corresponding to shifting a signal backward in time), $|\Delta d_b^L(i)|$ samples may be added to the signal in frequency band b. Correspondingly, when $\Delta d_b^L(i)$ is bigger than zero (e.g., a positive value), $\Delta d_b^L(i)$ samples may be removed from the signal in frequency band b. In both latter cases the actual processing may be quite similar.

To modify the length of a frame with $|\Delta d_b^L(i)|$ samples, the frame may be divided into $|\Delta d_b^L(i)|$ segments of length $\lfloor N/|\Delta d_b^L(i)| \rfloor$ samples, where N is the length of the frame in samples, and $\lfloor \cdot \rfloor$ denotes rounding towards minus infinity. Based on the sign of $\Delta d_b^L(i)$, one sample may be either removed or added in every segment. The perceptually least sensitive instant of the segment may be used for the removal or addition of samples. Since, in one example, the frequency bands for which the modifications are performed may represent frequencies below 2 kHz, the content of the frequency band signals may be slowly evolving sinusoidal shapes. For such signals, the perceptually safest instant for the modification is the instant where the difference between amplitudes of adjacent samples is smallest. In other words, for example, instant $$\min_k(|s(k)-s(k-1)|+|s(k+1)-s(k)|)$$

maybe searched, where s(t) is the current segment. Other embodiments, possibly processing a different set of frequency bands my use different criteria for selecting a point of signal modification.

Adding a new sample to s(t) may be straightforward in that a new sample may be added to instant k, for example, with a value (s(k−1)+s(k))/2, and the indexes of the remaining vector may be increased by one. Optionally, some embodiments may employ smoothing in a manner similar to one described for removing a sample from the signal below. As such, for example, s(k) in an original segment is represented by s(k+1) in the modified segment, etc. When a sample is removed, slight smoothing of the signal around the removed sample may be performed in order to ensure that no sudden changes occur in the amplitude value. For example, let s(k) be the sample which will be removed. Then, samples before and after s(k) may be modified as follows:

$$s(k-1)=0.6s(k-1)+0.4s(k)$$

$$s(k+1)=0.6s(k+1)+0.4s(k).$$

Thus, the original value of the sample preceding the removed sample is replaced with a value computed as a linear combination of its original value and the value of the removed sample. In a similar manner, the original value of the sample following the removed sample is replaced with a value computed as a linear combination of its original value and the value of the removed sample. Subsequently, sample s(k) may be removed from the segment and the indexes of samples after the original s(k) may be decreased by one. Of note, more advanced smoothing can be used both when adding and removing samples. However, in some cases, considering only adjacent samples may provide acceptable quality. Note that in the approaches for inserting and removing samples describe above, the desired time shift is fully reached in the end of a frame that is being modified. Other embodiments may use different processing for inserting or removing samples. For example, the samples may be inserted as one or several subblocks—a size of which sums up to the desired time shift—in perceptually safe instants of the signal. An embodiment implementing this kind of processing may or may not perform smoothing of the signal around the edges of inserted subblocks. In a similar manner, the samples can be removed as one or several subbocks, a combined size of which may introduce the desired time shift.

When all the frequency bands have been processed, the frequency bands of a channel may be combined. To make sure that the above described modification has not created any disturbing artifacts to certain frequencies (e.g., the high frequencies) it may be reasonable to first combine only those frequency bands that have been modified (e.g. frequencies below 2 kHz) and perform suitable lowpass filtering. For example, if frequencies below 2 kHz have been modified, the cut-off frequency of the lowpass filter may be about 2.1 kHz. After the lowpass filtering, the unmodified frequency bands (e.g. the ones above 2 kHz) may be combined to the signal and the delay caused by the lowpass filtering may be considered when combined signals.

After time differences between input channels have been removed, the signals may either be inputted to a stereo codec (e.g., the stereo encoder 12) or combined and inputted to mono codec (e.g., the mono encoder 32). When the binaural encoder 30 is used with a mono codec, signal level information may also be extracted from the channels of the input signal, as described above. The level information is typically calculated separately for each frequency band. In this context, level information may be calculated either utilizing the frequency band division used for the time difference analysis or, alternatively, a separate—and different—division to frequency bands may be used for extracting the information on signal levels.

Similar to the descriptions provided above, the decoder side may perform inversely with respect to the described processes of the encoder side. Thus, for example, time differences may be restored to the signals and, in the case of mono codec, also the signal levels may be returned to their original values.

In some embodiments, the codec may cause some processing and/or algorithmic delay for the input signals. In this regard, for example, creating the time domain frequency band signals may cause a delay that may be dependent on lengths of the filters employed in dividing the signal into the frequency bands. In addition, the signal modification itself may cause a delay, which may be in a maximum of K samples. Additionally, possible lowpass filtering may cause a delay dependent on the length of filter employed. Moreover, in an example embodiment windows centered at a modification window boundary may be employed to estimate the time difference values used to derive the time shift values used for signal modification, as the boundary may be considered to be the instant where the shift of the signal matches the estimated time difference. Thus, example embodiments such as the preceding embodiment may provide for the implementation of a time shift by modifying a signal in the time domain such that modification points are selected at perceptually less sensitive time instants. Furthermore, signal smoothing may be performed around the modification points.

Other alternative implementations may also be evident in light of the examples and descriptions provided herein. In this regard, for example, among other alternatives, modification may be performed in frequency bands, modification may be distributed over a frame so that no large sudden changes in signal are experienced, and/or perceptually less sensitive instants of the signal may be searched for modification. Other changes may also be employed.

As described above, embodiments of the present invention may provide for improved quality for encoded (or otherwise processed) binaural, stereo, or other multi-channel signals. In this regard, embodiments of the present invention may provide for the preservation of time difference within an encoded signal that may be used at the decoder side for signal reconstruction by restoration of the time difference. Moreover, some embodiments may operate with relatively low bit rates to provide better quality than conventional mechanisms.

An apparatus capable of operating in accordance with embodiments of the present invention will now be described in connection with FIG. 4. In this regard, FIG. 4 illustrates a block diagram of an apparatus for providing improved audio processing according to an example embodiment. The apparatus of FIG. 4 may be employed, for example, on a mobile terminal such as a portable digital assistant (PDAs), pager, mobile television, gaming device, laptop computer or other mobile computer, camera, video recorder, mobile telephone GPS device, portable audio (or other media including audio) recorder or player. However, devices that are not mobile may also readily employ embodiments of the present invention. For example, car, home or other environmental recording and/or stereo playback equipment including commercial audio media generation or playback equipment may benefit from embodiments of the present invention. It should also be noted, that while FIG. 4 illustrates one example of a configuration of an apparatus for providing improved audio processing, numerous other configurations may also be used to implement embodiments of the present invention.

Referring now to FIG. 4, an apparatus for providing improved audio processing is provided. The apparatus may include or otherwise be in communication with a processor 70, a user interface 72, a communication interface 74 and a memory device 76. The memory device 76 may include, for example, volatile and/or non-volatile memory. The memory device 76 may be configured to store information, data, applications, instructions or the like for enabling the apparatus to carry out various functions in accordance with example embodiments of the present invention. For example, the memory device 76 could be configured to buffer input data for processing by the processor 70. Additionally or alternatively, the memory device 76 could be configured to store instructions for execution by the processor 70. As yet another alternative, the memory device 76 may be one of a plurality of databases that store information and/or media content.

The processor 70 may be embodied in a number of different ways. For example, the processor 70 may be embodied as various processing means such as a processing element, a coprocessor, a controller or various other processing devices including integrated circuits such as, for example, an ASIC (application specific integrated circuit) or an FPGA (field programmable gate array). In an example embodiment, the processor 70 may be configured to execute instructions stored in the memory device 76 or otherwise accessible to the processor 70.

Meanwhile, the communication interface 74 may be embodied as any device or means embodied in either hardware, software, or a combination of hardware and software that is configured to receive and/or transmit data from/to a network and/or any other device or module in communication with the apparatus. In this regard, the communication interface 74 may include, for example, an antenna and supporting hardware and/or software for enabling communications with a wireless communication network. In fixed environments, the communication interface 74 may alternatively or also support wired communication. As such, the communication interface 74 may include a communication modem and/or other hardware/software for supporting communication via cable, digital subscriber line (DSL), universal serial bus (USB) or other mechanisms. In some embodiments, the communication interface 74 may provide an interface with a device capable or recording media on a storage medium or transmitting a bit stream to another device. In alternative embodiments, the communication interface 74 may provide an interface to a device capable of reading recorded media from a storage medium or receiving a bit stream transmitted by another device.

The user interface 72 may be in communication with the processor 70 to receive an indication of a user input at the user interface 72 and/or to provide an audible, visual, mechanical or other output to the user. As such, the user interface 72 may include, for example, a keyboard, a mouse, a joystick, a touch screen display, a conventional display, a microphone, a speaker (e.g., headphones), or other input/output mechanisms. In some example embodiments, the user interface 72 may be limited or even eliminated.

In an example embodiment, the processor 70 may be embodied as, include or otherwise control a signal divider 78, a channel selector 80, a time shift determiner 82, an encoder 84, and/or a decoder 86. The signal divider 78, the channel selector 80, the time shift determiner 82, the encoder 84, and the decoder 86 may each be any means such as a device or circuitry embodied in hardware, software or a combination of hardware and software that is configured to perform the corresponding functions of the signal divider 78, the channel selector 80, the time shift determiner 82, the encoder 84, and the decoder 86, respectively, as described below. In some embodiments, the apparatus may include only one of the encoder 84 and decoder 86. However, in other embodiments, the apparatus may include both. One or more of the other portions of the apparatus could also be omitted in certain embodiments and/or other portions not mentioned herein could be added. Furthermore, in some embodiments, certain ones of the signal divider 78, the channel selector 80, the time shift determiner 82, the encoder 84, and the decoder 86 may be physically located at different devices or the functions of some or all of the signal divider 78, the channel selector 80, the time shift determiner 82, the encoder 84, and the decoder 86 may be combined within a single device (e.g., the processor 70).

In an example embodiment, the signal divider 78 may be configured to divide each channel of a multiple channel input signal into a series of analysis frames using analysis window as described above. The frames and/or windows may be overlapping or non-overlapping. In some cases, the signal divider 78 may comprise a filter bank as described above, or another mechanism for dividing the analysis frames into spectral bands. The signal divider 78 may operate to divide signals as described above whether the signal divider 78 is embodied at the apparatus comprising an encoder and operating as an encoding device or comprising a decoder and operating as a decoding device.

The channel selector 80 may be in communication with the signal divider 78 in order to receive an output from the signal divider 78. The channel selector may be further configured to select one of the input channels as the leading channel for selected spectral bands in each analysis frame. As indicated above, the channel selected as the lead channel may be selected based on various different selection criteria.

The time shift determiner 82 may be configured to determine a time shift value for each channel. In this regard, for example, the time shift determiner 82 may be configured to determine a temporal difference measure (e.g., the interchannel time difference (ICTD)) for selected spectral bands in each analysis frame by, for example, using cross-correlation between signal segments as the measure of similarity. A time shift for each channel may then be determined and the channels may be aligned according to the determined time shift in such a way that the non-leading channels for any given frame may be shifted according to the determined time shift. When embodied in a device operating as an encoder, the time shift determiner 82 may determine time shift parameters for encoding. In this regard, for example, the time shift determiner 82 may be further configured to time align signals between different channels based on the determined time shift parameters. However, if the time shift determiner 82 is embodied at a device operating as a decoder, the time shift determiner 82 may be configured to determine time shift parameters encoded for communication to the decoder for use in restoring time delays based on the determined time shift parameters.

The encoder 84 may be configured to encode time aligned signals for further processing and/or transmission. In this regard, for example, the encoder 84 may be embodied as a stereo encoder or a mono encoder that may be known in the art.

The decoder 86 may be configured to decode time aligned signals as described above in connection with the binaural decoder 36 or the delay restoration device 16. As such, for example, the time shift determiner 82 may be further configured to restore the time difference in a multi-channel synthesized output signal based on received time shift parameters at selected spectral bands in each analysis frame.

FIGS. 5 and 6 are flowcharts of a system, method and program product according to example embodiments of the invention. It will be understood that each block or step of the flowcharts, and combinations of blocks in the flowcharts, can be implemented by various means, such as hardware, firmware, and/or software including one or more computer program instructions. For example, one or more of the procedures described above may be embodied by computer program instructions. In this regard, the computer program instructions which embody the procedures described above may be stored by a memory and executed by a processor (e.g., the processor 70). As will be appreciated, any such computer program instructions may be loaded onto a computer or other programmable apparatus (i.e., hardware) to produce a machine, such that the instructions which execute on the computer or other programmable apparatus create means for implementing the functions specified in the flowcharts block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowcharts block(s) or step(s). The computer program instructions may also be loaded onto a computer or other programmable apparatus (e.g., the processor 70) to cause a series of operational steps to be performed on the computer or other programmable apparatus to produce a computer-implemented process such that the instructions which execute on the computer or other programmable apparatus provide steps for implementing the functions specified in the flowcharts block(s) or step(s).

Accordingly, blocks or steps of the flowcharts support combinations of means for performing the specified functions, combinations of steps for performing the specified functions and program instruction means for performing the specified functions. It will also be understood that one or more blocks or steps of the flowcharts, and combinations of blocks or steps in the flowcharts, can be implemented by special purpose hardware-based computer systems which perform the specified functions or steps, or combinations of special purpose hardware and computer instructions.

In this regard, one embodiment of a method of providing audio processing may comprise dividing respective signals of each channel of a multi-channel audio input signal into one or more spectral bands corresponding to respective analysis frames at operation 100 and selecting a leading channel from among channels of the multi-channel audio input signal for at least one spectral band at operation 110. The method may further comprise determining a time shift value for at least one spectral band of at least one channel at operation 120 and time aligning the channels based at least in part on the time shift value at operation 130.

In an example embodiment, dividing respective signals of each channel may comprise dividing respective signals of each channel into spectral bands corresponding to respective overlapping or non-overlapping analysis frames. In some cases, a filter bank may be used for the dividing in which the filter bank does not perform downsampling. In an example embodiment, selecting the leading channel may comprise selecting the leading channel based on which channel detects an occurrence of an event first. In some embodiments, determining the time shift value may comprise determining a separate time shift value for each channel. However, in some cases, the leading channel may remain unmodified and only the non-leading channel may have a time shift value applied thereto. In some example embodiments, the method may comprise providing an indication of the leading channel and applied time shifts to a delay restoration device or a binaural decoder to enable inverse operation in the receiving end. In an example embodiment, the time shift values may be determined relative to a leading channel for a channel other than the leading channel for a set of spectral bands.

In an example embodiment, an apparatus for performing the method above may comprise a processor (e.g., the processor 70) configured to perform each of the operations (100-130) described above. The processor may, for example, be configured to perform the operations by executing stored instructions or an algorithm for performing each of the operations. Alternatively, the apparatus may comprise means for performing each of the operations described above. In this regard, according to an example embodiment, examples of means for performing operations 100 to 130 may comprise, for example, an algorithm for controlling band forming, channel selection, time shift determinations, and encoding as described above, the processor 70, or respective ones of the signal divider 78, the channel selector 80, the time shift determiner 82, and the encoder 84.

In another example embodiment, as shown in FIG. 6, a method of providing improved audio processing may comprise dividing a time aligned decoded audio input signal into one or more spectral bands corresponding to respective analysis frames for multiple channels at operation 200. The method may further comprise receiving time alignment information comprising time shift values for one or more channels in one or more spectral bands and possibly an indication on the leading channel at operation 210, and restoring time differences between the multiple channels using the time shift values to provide a synthesized multi-channel output signal at operation 220. In an example embodiment, dividing the time aligned decoded audio input signal may comprise dividing each channel into spectral bands corresponding to respective overlapping or non-overlapping analysis frames.

In an example embodiment, an apparatus for performing the method of FIG. 6 above may comprise a processor (e.g., the processor 70) configured to perform each of the operations (200-220) described above. The processor may, for example, be configured to perform the operations by executing stored instructions or an algorithm for performing each of the operations. Alternatively, the apparatus may comprise means for performing each of the operations described above. In this regard, according to an example embodiment, examples of means for performing operations 200 to 220 may comprise, for example, an algorithm for controlling band forming, time shift determinations, and decoding as described above, the processor 70, or respective ones of the signal divider 78, the time shift determiner 82, and the decoder 86.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method comprising:

dividing respective signals of each channel of a multi-channel audio input signal into one or more spectral bands corresponding to respective analysis frames;

selecting a leading channel from among channels of the multi-channel audio input signal for at least one spectral band;

determining a time shift value for at least one spectral band of at least one channel; and time aligning the channels based at least in part on the time shift value.

2. The method of claim 1, wherein the time aligning comprises modifying a signal of at least one spectral band of at least one channel other than the leading channel selected for a respective spectral band based at least in part on a respective time shift value.

3. The method of claim 1, wherein dividing respective signals of each channel comprises dividing respective signals of each channel into spectral bands corresponding to respective overlapping analysis frames.

4. The method of claim 1, wherein dividing respective signals of each channel comprises dividing respective signals of each channel into spectral bands corresponding to respective non-overlapping analysis frames.

5. The method of claim 1, wherein selecting the leading channel comprises selecting the leading channel based on which channel an occurrence of an event is detected first.

6. The method of claim 1, wherein determining the time shift value comprises determining a separate time shift value for each channel.

7. The method of claim 1, further comprising combining the time aligned channels for further processing.

8. The method of claim 1, wherein dividing respective signals of each channel comprises passing the multi-channel audio input signal through a filter bank that does not perform downsampling for the spectral bands.

9. An apparatus comprising a processor; and a memory including computer program code, the memory and the computer program code configured to, with the processor, cause the apparatus to at least:

divide respective signals of each channel of a multi-channel audio input signal into one or more spectral bands corresponding to respective analysis frames;

select a leading channel from among channels of the multi-channel audio input signal for at least one spectral band;

determine a time shift value for at least one spectral band of at least one channel; and time align the channels based at least in part on the time shift value.

10. The apparatus of claim 9, wherein the memory including the computer program code is further configured to, with the processor, cause the apparatus to time align by modifying a signal of at least one spectral band of at least one channel other than the leading channel selected for a respective spectral band based at least in part on a respective time shift value.

11. The apparatus of claim 9, wherein the memory including the computer program code is further configured to, with the processor, cause the apparatus to divide respective signals of each channel by dividing respective signals of each channel into spectral bands corresponding to respective overlapping analysis frames.

12. The apparatus of claim 9, wherein the memory including the computer program code is further configured to, with the processor, cause the apparatus to divide respective signals of each channel by dividing respective signals of each channel into spectral bands corresponding to respective non-overlapping analysis frames.

13. The apparatus of claim 9, wherein the memory including the computer program code is further configured to, with the processor, cause the apparatus to combine the time aligned channels for further processing.

14. The apparatus of claim 9, wherein the memory including the computer program code is further configured to, with the processor, cause the apparatus to select the leading channel by selecting the leading channel based on which channel an occurrence of an event is detected first.

15. The apparatus of claim 9, wherein the memory including the computer program code is further configured to, with the processor, cause the apparatus to determine the time shift value by determining a separate time shift value for each channel.

16. The apparatus of claim 9, wherein the memory including the computer program code is further configured to, with the processor, cause the apparatus to divide respective signals of each channel by passing the multi-channel audio input signal through a filter bank that does not perform downsampling for the spectral bands.

17. A computer program product comprising at least one computer-readable non-transitory storage medium having computer-executable program code portions stored therein, the computer-executable program code portions comprising:

a first program code portion for dividing respective signals of each channel of a multi-channel audio input signal into one or more spectral bands corresponding to respective analysis frames;

a second program code portion for selecting a leading channel from among channels of the multi-channel audio input signal for at least one spectral band;

a third program code portion for determining a time shift value for at least one spectral band of at least one channel; and a fourth program code portion for time aligning the channels based at least in part on the time shift value.

18. The computer program product of claim 17, wherein the fourth program code portion includes instructions for modifying a signal of at least one spectral band of at least one channel other than the leading channel selected for a respective spectral band based at least in part on a respective time shift value.

19. The computer program product of claim 17, wherein the first program code portion includes instructions for dividing respective signals of each channel into spectral bands corresponding to respective overlapping analysis frames.

20. The computer program product of claim 17, wherein the first program code portion includes instructions for dividing respective signals of each channel into spectral bands corresponding to respective non-overlapping analysis frames.

21. The computer program product of claim 17, wherein the second program code portion includes instructions for selecting the leading channel based on which channel detects an occurrence of an event first.

22. The computer program product of claim 17, wherein the third program code portion includes instructions for determining a separate time shift value for each channel.

23. The computer program product of claim 17, wherein the fourth program code portion includes instructions for combining the time aligned channels for further processing.

24. The computer program product of claim 17, wherein the first program code portion includes instructions for passing the multi-channel audio input signal through a filter bank that does not perform downsampling for the spectral bands.

25. A method comprising:

dividing a time aligned decoded audio input signal into one or more spectral bands corresponding to respective analysis frames for multiple channels;

receiving time alignment information comprising time shift values for one or more channels in one or more spectral bands; and restoring time differences between the multiple channels using the time shift values to provide a synthesized multi-channel output signal.

26. The method of claim 25, wherein dividing the time aligned decoded audio input signal comprises dividing each channel into spectral bands corresponding to respective overlapping or non-overlapping analysis frames.

27. An apparatus comprising:

a processor; and a memory including computer program the memory and the computer program code configured to, with the processor, cause the apparatus to at least:

divide a time aligned decoded audio input signal into one or more spectral bands corresponding to respective analysis frames for multiple channels;

receive time alignment information comprising time shift values for one or more channels in one or more spectral bands; and restore time differences between the multiple channels using the time shift values to provide a synthesized multi-channel output signal.

28. The apparatus of claim 27, wherein the memory including the computer program code is further configured to, with the processor, cause the apparatus to divide the time aligned decoded audio input signal by dividing each channel into spectral bands corresponding to respective overlapping or non-overlapping analysis frames.

29. A computer program product comprising at least one computer-readable non-transitory storage medium having computer-executable program code portions stored therein, the computer-executable program code portions comprising:

a first program code portion for dividing a time aligned decoded audio input signal into one or more spectral bands corresponding to respective analysis frames for multiple channels;

a second program code portion for receiving time alignment information comprising time shift values for one or more channels in one or more spectral bands; and a third program code portion for restoring time differences between the multiple channels using the time shift values to provide a synthesized multi-channel output signal.

30. The computer program product of claim 29, wherein the first program code portion includes instructions for dividing each channel into spectral bands corresponding to respective overlapping or non-overlapping analysis frames.

* * * * *

UNITED STATES PATENT AND TRADEMARK OFFICE

CERTIFICATE OF CORRECTION

PATENT NO. : 8,355,921 B2
APPLICATION NO. : 12/139101
DATED : January 15, 2013
INVENTOR(S) : Tammi et al.

It is certified that error appears in the above-identified patent and that said Letters Patent is hereby corrected as shown below:

In the Specification:

Column 7,
Lines 11-19 should appear as follows:

$$L_b^d(iN+k) = L_b(iN+k)$$

$$R_b^d(iN+k) = R_b(iN+k+d_b(i))$$

otherwise (e.g., if $R_b$ is the leading channel)

$$L_b^d(iN+k) = L_b(iN+k+d_b(i))$$

$$R_b^d(iN+k) = R_b(iN+k)$$

Column 9,
Lines 3-11 should appear as follows:

$$\hat{L}_b^d(iN+k) = \hat{L}_b(iN+k)$$

$$\hat{R}_b^d(iN+k+d_b(i)) = \hat{R}_b(iN+k)$$

otherwise (i.e. If $R_b$ is the leading channel)

$$\hat{L}_b^d(iN+k+d_b(i)) = \hat{L}_b(iN+k)$$

$$\hat{R}_b^d(iN+k) = \hat{R}_b(iN+k)$$

In the Claims:

Column 22,
Line 27, "computer program the memory" should read –computer program code, the memory–.

Signed and Sealed this
Third Day of September, 2013

Teresa Stanek Rea
*Acting Director of the United States Patent and Trademark Office*